United States Patent [19]

Kasza et al.

[11] Patent Number: 4,682,137

[45] Date of Patent: Jul. 21, 1987

[54] MAGNETIZING APPARATUS FOR THE MAGNETIZATION OF KEYS AND ROTORS OF MAGNETIC SAFETY LOCK SYSTEMS

[75] Inventors: Tibor Kasza; Gyula Kákonyi; Illés Kócso; Attila Buzás; László Radványi, all of Budapest, Hungary

[73] Assignee: Elzett Muvek, Budapest, Hungary

[21] Appl. No.: 777,208

[22] Filed: Sep. 18, 1985

[30] Foreign Application Priority Data

Sep. 28, 1984 [HU] Hungary ..... 3679/84

[51] Int. Cl.[4] ..... H01F 7/20

[52] U.S. Cl. ..... 335/284; 361/147; 70/413

[58] Field of Search ..... 335/284; 70/413; 361/143, 147

[56] References Cited

U.S. PATENT DOCUMENTS

| | | | |
|---|---|---|---|
| 4,003,336 | 1/1977 | Koester et al. | 335/284 X |
| 4,043,297 | 8/1977 | Hartmann et al. | 335/284 X |
| 4,379,276 | 4/1983 | Bouchara et al. | 335/284 |
| 4,382,244 | 5/1983 | Koester et al. | 335/284 |

*Primary Examiner*—Patrick R. Salce
*Assistant Examiner*—Anita M. Ault
*Attorney, Agent, or Firm*—Handal & Morofsky

[57] ABSTRACT

The invention relates to magnetizing apparatus for the magnetization with coded orientation of magnetic blades (6) to be embedded into two sides of a magnetic key shank forming part of a magnetic safety lock system, wherein tapering flux-conducting soft iron shanks (2, 4) are coupled to the poles of an exciting magnet (1) of the apparatus. Between the shanks is an air gap (3) into which a feeding mechanism feeds the blades (6) to be magnetized.

The magnet is a permanent magnet (1) made of intermetallic compounds of rare earth metals of shell 4*f* with transition metals of shell 3*d* by means of powder metallurgy or casting. The areas of the soft iron (2) which are contiguous to the air gap (3) are made of a material of high saturation value. The direction of the feed of magnetic blades (6) is parallel with the direction of the magnetic field (dipole) of the poles of the flux-conducting soft iron (2).

The invention also includes apparatus for the total through-magnetization of the rotor discs of the lock-inserts of magnetic safety locks. In this variant, there are two symmetric magnetic cirucits, with permanent magnets (1, 1*a*) made of intermetallic compounds as above, with pairs of soft irons (2, 2*a*) and tapering shanks (4, 4*a*) facing one another across an air gap (14) and being of opposite polarity.

5 Claims, 8 Drawing Figures

MAGNETIZING APPARATUS FOR THE MAGNETIZATION OF KEYS AND ROTORS OF MAGNETIC SAFETY LOCK SYSTEMS

The invention relates to a magnetising apparatus for the magnetisation of magnetic keys and magnetic rotors of magnetic safety lock systems.

It is generally believed that magnetic lock-inserts constitute one of the most up-to-date types of safety locks, wherein code-controlled magnetic rotor disks are disposed in the magnetic lock-inserts while magnetic blades or platelets for turning the magnetic disks into their closing and opening positions respectively, are embedded on opposite sides of the magnetic key.

No. DE-B-2539757 relates to keys for magnetic cylinder locks in which two-part magnets are inserted into the key, with a ferromagnetic screening layer disposed therebetween whereby the fields of the individual magnets are screened from one another.

No. AT-B-358,143 discloses magnetising apparatus for generating a magnetic dipole on the surface of the ferromagnetic material. According to this solution, the magnetisation of the surface is carried out by a secondary coil consisting of one single turn formed by a metal tube that tapers at the area required to be magnetised as well as by a metal ring.

No. AT-B-352,840 describes a head for the magnetisation of the magnetic blades of the key. The blades to be magnetised are inserted into the key unmagnetised and the key is placed into the magnetising apparatus in which magnetisation of the blades in a coded orientation is carried out.

No. DE-B-2,558,159 relates to a magnetising apparatus which makes it possible to make orthogonal contact with the exact area of the surface to be magnetised by a needle-thin loop. After contact with the surface, the loop is fed with an electric current whereby a magnetic dipole is generated.

According to all these solutions and to the evidence found in numerous other relevant technical publications, the manufacturers of magnetic lock-inserts use electric current impulses for the magnetisation of the operating bodies, i.e. magnetic keys and magnetic rotors. The application of wire loops coils or flux-conducting iron members has, however, many disadvantages, as follows:

1. An electric current impulse in the magnitude of 1000 A exerts a very great dynamic effect on the object to be magnetised, therefore the construction of a conductor-loop forming the magnetising head in small dimensions while having a suitable mechanical stability is extremely difficult.
2. In the case of magnetisation by means of electric current by electric impulses the direction of magnetic field is characterised by concentric circles. The field intensity can be expressed by the formula:

$$H = \text{constant}/\frac{\text{current}}{\text{radius}}$$

This law, i.e. functional relationship, greatly restricts the magnitude of the force effect between two magnetic bodies of given dimensions, because the directions of magnetisation inside the magnetic bodies, e.g. magnetic keys and rotor inserts of the magnetic safety locks, cannot be optimised.

3. The current impulse magnitude of 100 A mentioned above poses heating problems as a consequence of which only very short impulses are permissible. Hence, the eddy current generated in the flux-conducting iron (pole) distorts the magnetic field, and consequently the optimum direction of magnetisation cannot be formed. The ideal direction of the field of magnetic flux lines could not hitherto be controlled because it greatly depended on the time-dependent variation of the current impulse.
4. It has always been a practical problem to maintain the current impulse at a stable, constant value i.e. to assure reproducibly identical direction of the magnetic field because the wide spread or scatter of the characteristics of the magnetic material causes disturbances distorting the magnetic field.
5. During the decay of the magnetising current, the intensity of the magnetic field diminishes to a critical value at which the configuration or "image" of the magnetic field is fixed or retained in the magnetic body. The reduction of the field intensity restricts the possible directions of magnetisation in the material to be magnetised.

The above-described disadvantages are particularly significant when magnetisation is to be carried out from two sides of a body to be magnetised. This is because magnetic keys cannot be magnetised to saturation because during magnetisation the other side of the key would be demagnetised (erased), i.e. the spread or scatter of the 'virgin' characteristic curve has a great effect on the surface remancence and on the extent of dipole formation on the surface.

An aim of the invention is to provide magnetising apparatus which eliminates or reduces the disadvantages described above.

The apparatus according to aspects of the invention is based on the recognition that using a permanent magnet made of an alloy/mixture of rare earth metal(s) and cobalt a small magnetic circuit can be created and, if a magnetic body is placed into its air gap, a functionally optimal direction of magnetisation can be achieved. A further recognition underlying the invention is to provide narrowing shanks for the flux-conducting soft iron magnetic poles and to make them of a Fe—Co—V alloy of high saturation value. The result of these measures applied to magnetisation with permanent magnets is not only to the controllable variability of the configuration of the magnetic field, but also a high degree of long-term stability of the direction of the magnetic field, minimum maintenance and excellent geometrical stability of the field.

The realisation of the above recognitions of the invention brings the great advantage that the rotor magnets of magnetic lock-inserts and magnetic plates or discs of magnetic keys can be magnetised reproducibly in a controllably stable direction of magnetisation. This makes it possible that by an angular displacement of the magnetic elements of magnetic lock-inserts in a pitch of 27.7° (360/13) and by magnetising once in a North-South direction, once in a South-North direction, $2\times13^6$ magnetic lock-insert combinations can be magnetised.

By assuring reproducibly stable directions of magnetisation, a departure from hitherto known manufacturing processes becomes possible whereby to enable magnetisation of the magnet-rotors and magnetic blades of magnetic keys individually in series of any size, in the magnetising apparatus according to the invention.

The blades of magnetic keys are magnetised according to a preselected code and are fixed at the two sides of the key. Similarly, the premagnetised rotor-magnets are fixed into the magnetic lock-insert.

The magnetising apparatus according to the invention makes it possible to magnetise the blades of magnetic keys to a settable depth from the surface. This brings the advantage that the magnetic fields of the two magnetised blades of the magnetic key do not disturb one another, whereby the necessity of placing a ferromagnetic shield or screening layer between the two blades of the magnetic key is obviated.

Magnetisation by means of a permanent magnet has the following advantages:

1. Geometric and time stability of the magnetic field.
2. A spontaneous fault or breakdown of the apparatus according to the invention is practically impossible, hence it needs minimal maintenance, its energy consumption is zero.
3. The shape or configuration of the generated magnetic force field may be freely selected.
4. Due to the heating up of the current conductors used in known processes of magnetisation by electric impulses, the number of performable magnetisations per hour was limited, whereas because of its use of permanent magnets the output of the magnetising apparatus according to the invention is limited only by the rate of loading of the automatic feeding mechanism associated with it.

The apparatus according to the invention is further described purely by way of example, with reference to preferred embodiments illustrated in the accompanying drawings, wherein:

FIG. 1 shows in first and second projection, a portion of the hysteresis curve of typical strontium-ferrite magnetic materials well illustrating the spread or scatter of the curves. Due to this scatter, different surface remanences arise in the magnetised surface.

Figure 1:
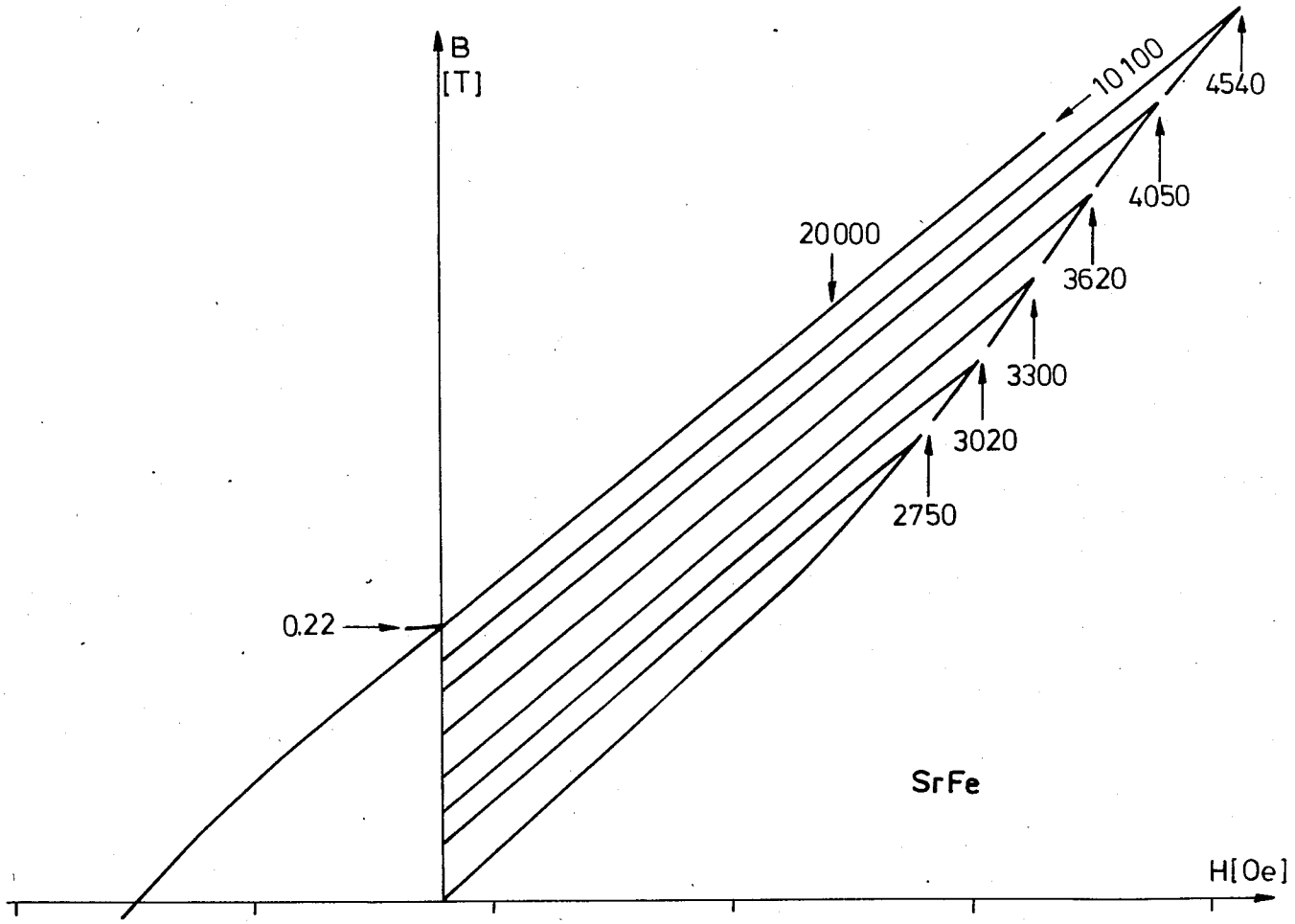
FIG. 1 shows the magnetic hysteresis curve of a typical isotropic strontium-ferrite magnet in the first and second space quarters or projections.
Figure 2:
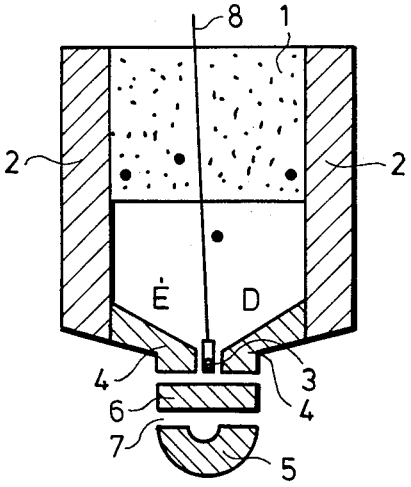
FIG. 2 is a schematic layout of the design of the magnetising apparatus for the magnetisation of the magnetic keys of magnetic safety locks according to the invention.

The principle of the magnetising apparatus according to the invention is shown in FIG. 2. This embodiment of the invention is developed for the magnetisation of the magnetic blades of the magnetic keys of magnetic lock-inserts wherein flux-conducting soft iron members 2 are fitted to the poles of a permanent magnet 1. Between the narrowing shanks 4 of the flux-conducting soft iron members 2 there is an air gap 3 into which a flux-guiding magnet 8 is placed. The shanks 4 of the flux-conducting soft iron members 2 form one flux-conducting element, while the other flux-conducting element is formed by a U-shaped soft iron member having an air gap 7 between it and the tapering shanks 4. The air gap 7 accommodates the magnetic blades or platelets 6 to be magnetised.

According to the invention, the permanent magnet 1 is the "source" of the exciting magnet. It is produced by powder metallurgy or by casting from intermetallic compounds of rare earth metals of atomic shell 4*f* combined with transition metals of shell 3*d* where the rare earth metal element is selected from at least one of the elements Pr, Nd, Y, Gd, La, Dy, Eu, Yb, Er, Ce and the transition metal element is selected from at least one of the metals Co, Ni, Fe. If required, the alloy may contain per se known additive(s) to improve its magnetic properties. At least those parts of the flux-conducting soft iron member 2 that are contiguous to air gap 3 are made of a material of high magnetic saturation value, e.g. alloys of Fe, Co, V. The direction of feed of a loading mechanism for feeding magnetic blades 6 to be magnetised into the apparatus is parallel with the direction of the magnetic field (dipole) of the poles of the flux-conducting soft iron members 2.

The thickness (depth) of the magnetised layer of the magnetic blades 6 is determined by the presence or absence of the U-shaped soft iron 5.

As may be seen in FIG. 2, a flux guiding deflector magnet 8 of RCo material (wherein R is a rare earth element) is placed in the air gap 3 between the narrowing shanks 4 of flux-conducting soft iron 2 for influencing the configuration of magnetic lines of force.

Figure 5:
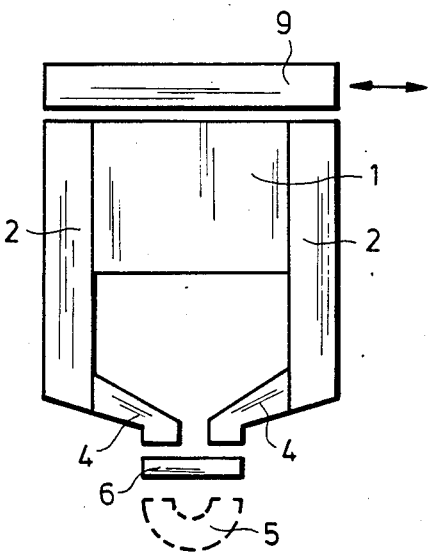
FIG. 5 illustrates a variant of the magnetising apparatus according to FIG. 2, fitted with a magnetic shunt.

The apparatus illustrated in FIG. 2 can also be applied to the traditional method of generating magnetic fields by intermittently applied electric impulses. If the apparatus according to the invention is used in this fashion, an intermittently closed/opened magnetic shunt 9 is placed between the poles of the permanent magnet 1 (FIG. 5).

The width of the U-shaped soft iron 5 is chosen to be identical with the width of the magnetic blades 6 of the magnetic key to be magnetised.

Figure 3:
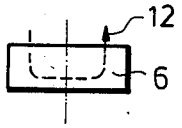
FIG. 3 illustrates the field direction of magnetic keys magnetised for maximum torque achievable with the apparatus according to the invention.

FIG. 3 shows the direction of magnetisation 12 after the magnetisation of the blade 6 has been completed. FIG. 3 illustrates quite clearly that during the process of magnetisation the blade 6 is not fully magnetised but received only surface magnetisation.

Figure 4:
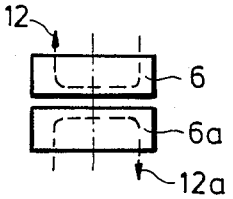
FIG. 4 shows the direction of magnetisation of the magnetic blades located on two sides of a magnetic lock-insert.

FIG. 4 illustrates the directions of magnetisation 12, 12*a* after magnetisation of the blades 6, 6*a* to be fixed to the magnetic key of the safety lock. Also, FIG. 4 shows clearly that the two surface-magnetised blades 6, 6*a* facing one another have no mutual disturbing effect on the configuration of their respective magnetic fields.

Figure 6:
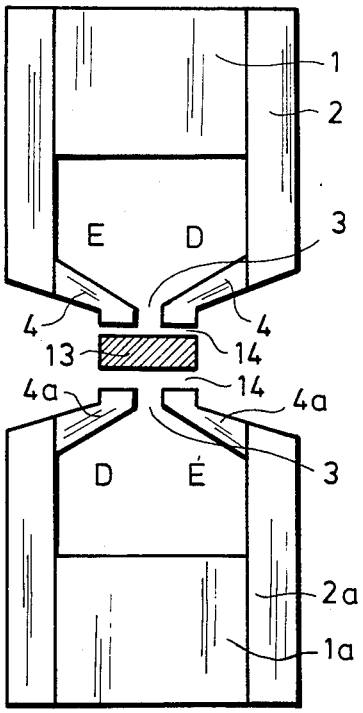
FIG. 6 illustrates an embodiment of the magnetising apparatus according to the invention for the magnetisation of magnetic rotors which are to be fully magnetised right through by means of magnetic lines of force.
Figure 7:
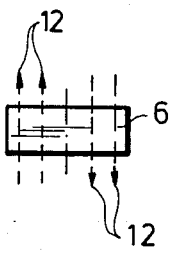
FIG. 7 shows a magnetic configuration generated in a magnetised rotor body.
Figure 8:
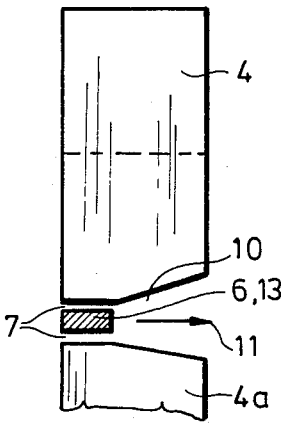
FIG. 8 illustrates the widening air gap of the magnetising apparatus according to the invention for the purpose of eliminating the distortion occurring at the edge of the magnetic circuit.

The embodiment of the invention illustrated in FIG. 6 is suitable for the full-depth, through-magnetisation of the magnetic rotors of magnetic lock-inserts as well as for producing magnets made from an anisotropic material. The apparatus according to the invention shown in FIG. 6 consists of two symmetric magnetic circuits. The permanent magnets 1 and 1*a* are the sources of magnetic induction and are made of an alloy which consists of intermetallic compounds of rare earth metals of shell 4*f* and transition metals of shell 3*d* and which are produced by means of powder metallurgy or casting.

Flux-conducting soft irons 2, 2*a* are fitted to the poles of permanent magnets 1, 1*a*. There is an air gap 3 between the tapering shanks 4, 4*a* of flux-conducting soft irons 2, 2*a*. The shanks 4, 4*a* are made of a material of high saturation value, e.g. an alloy of Fe, Co, V. There is an air gap 14 for receiving rotor disks 13 to be magnetised between the ends of shanks 4, 4*a* facing one another and of opposite polarity. A feeding mechanism for loading rotor-disks into the apparatus is associated with the air gap 14. The direction of feed of loading mechanism is parallel with the magnetic field of the magnetic poles of the tapering shanks 4, 4*a* of the flux-conducting soft irons 2, 2*a*. Between the tapering shanks 4, 4*a* of the flux-conducting soft or irons 2, 2*a* is a gap 10 that widens in the direction of loading of the blades 6 or rotor disks 11. This widening gap 10 assures that the direction of the forces of the magnetic field of the magnetised blades 6 and rotor disks 13 formed during magnetisation does not vary.

In the embodiments of the invention illustrated in FIGS. 2, 5 and 6 the blades 6 or rotor-disks 13 are passed through the magnetic field at any desired speed in a direction perpendicular to the plane of the drawings. This is the simplest and most efficient method of magnetisation. The required direction of the magnetism remanent in the magnetic body can be attained by means of suitably shaping of the magnetic configuration of the pole ends and the flux-conductor. The intensity of the magnetic circuit can be adjusted by the per se known method of suitably dimensioning the circuit. The apparatus according to the invention may most advantageously be used for the production of magnetic keys of magnetic safety locks, i.e. for the magnetisation of divided bodies wherein two oppositely situated magnetic disk blades are to be produced with the respective configurations of the magnetic field being of different direction and depth.

FIG. 2 shows a flux-guiding magnet 8, which is placed in the air gap 3 in the opposite sense to the magnetic polarity of the tapering shanks 4 of the flux-conducting soft iron 2. Due to the RCo material (rare earth metal-cobalt) of the flux-guiding magnet 8 with a $H_C^J$-value in excess of 1200 kA/m, it does not demagnetise but modifies the shape of the magnetic field generated in the 'main magnet' in its neighbourhood, thus optimising the magnetisation for the operating force.

We claim:

1. Magnetizing apparatus for the magnetization of magnetic blades to be journalled into two sides of the shank of a key for magnetic safety locks by means of surface magnetization with coded orientation, comprising an exciting magnet, magnetic flux-conducting soft iron members having tapering shanks connected with the poles of the exciting magnet of the apparatus and an air-gap formed between the ends of the shanks of the magnetic flux-conducting soft iron members, wherein the exciting magnet of the apparatus is a permanent magnet made of intermetallic compounds of rare earth metals of shell 4*f* and transition metals of shell 3*d* produced by means of powder metallurgy or casting, the rare earth metal consisting of at least one of Sm, Pr, Nd, Y, Gd, La, Dy, Eu, Yb, Er and Ce and the transition metal consisting of at least one of Fe, Co and Ni for improving the magnetic properties of the material; and wherein at least portions of said soft irons contiguous to said air gap are made of a material of high magnetic saturation value, e.g. an alloy of Fe, Co, V; wherein the direction of the feed of said blades is parallel with the direction of a magnetic field across the poles of the flux-conducting soft iron members, and wherein a flux-guiding magnet made of an RCo alloy (where R represents a rare earth metal) is placed into the air gap between the tapering shanks of the flux-conducting soft iron fitted to the permanent magnet.

2. Magnetizing apparatus according to claim 4, wherein the flux-conducting soft iron members are comprised of first and second flux conducting soft iron members having tapered shanks and third, U-shaped flux conducting soft iron member facing said shanks which are fitted to the permanent magnet of the apparatus; said U-shaped soft iron being fitted in the air gap for accomodating the blades to be magnetized in the apparatus; the width of the U-shaped soft iron being identical with the width of said blades.

3. Magnetising apparatus according to claim 1, wherein the U-shaped soft iron forming the other part of the flux-conducting soft iron members represents a constructional element of the apparatus that determines the depth of magnetisation of the magnetic blades.

4. Magnetising apparatus according to claim 1, wherein a magnetic shunt that can be opened and closed for assuring intermittent operation of the apparatus is placed between the poles of permanent magnet.

5. Magnetizing apparatus for the full-depth magnetization of rotor disks of lock inserts of magnetic safety locks by means of parallel lines of magnetic force, comprising exciting magnet means having poles connected to tapering flux-conducting soft iron shanks producing a magnetic field and between the ends of which an air gap is formed, wherein the magnetizing apparatus consists of two magnetic circuits of symmetrical field configuration, the exciting magnet means being permanent magnets produced from intermetallic compounds of rare earth metals of shell 4*f* with transition metals of shell 3*d* by means of power metallurgy or casting, with the tapering shanks being made of a material of high saturation value, e.g. an alloy of Fe, Co, V, a first air gap formed between the shanks of each circuit and a second air gap for accomodating the rotor disks to be magnetized and formed between the facing ends of the respective pairs of shanks of the two magnetic circuits, said shank pairs having mutually opposite magnetic polarity, wherein said rotor disks are fed into said second air gap in a direction parallel with the direction of the magnetic field of the magnetic poles of the tapering shanks of the flux-conducting soft irons, wherein said second air gap is widening in the direction of feeding of the magnetic blades.

* * * * *